US007213897B2

(12) United States Patent
Kosugi

(10) Patent No.: US 7,213,897 B2
(45) Date of Patent: May 8, 2007

(54) INK-JET PRINTER

(75) Inventor: Yasuhiko Kosugi, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/070,125

(22) PCT Filed: Jul. 3, 2001

(86) PCT No.: PCT/JP01/05757

§ 371 (c)(1),
(2), (4) Date: Mar. 1, 2002

(87) PCT Pub. No.: WO02/02337

PCT Pub. Date: Jan. 10, 2002

(65) Prior Publication Data

US 2002/0135630 A1 Sep. 26, 2002

(30) Foreign Application Priority Data

Jul. 3, 2000 (JP) ..... 2000-201274

(51) Int. Cl.
*B41J 29/38* (2006.01)

(52) U.S. Cl. ..... 347/5; 347/19; 347/86

(58) Field of Classification Search ..... 347/5, 347/7, 19, 37, 50, 86, 97; 400/174
See application file for complete search history.

(56) References Cited

U.S. PATENT DOCUMENTS

| | | | | |
|---|---|---|---|---|
| 5,049,898 A | | 9/1991 | Arthur et al. | |
| 5,567,063 A | * | 10/1996 | Chiu | 400/174 |
| 5,589,859 A | | 12/1996 | Schantz | |
| 5,610,635 A | * | 3/1997 | Murray et al. | 347/7 |
| 6,302,527 B1 | * | 10/2001 | Walker | 347/50 |
| 6,312,106 B1 | * | 11/2001 | Walker | 347/50 |
| 2002/0015066 A1 | | 2/2002 | Siwinski et al. | |

FOREIGN PATENT DOCUMENTS

| | | |
|---|---|---|
| EP | 0644057 A | 3/1995 |
| JP | 2-279344 | 11/1990 |
| JP | 08-281927 A | 10/1996 |
| JP | 10-221938 A | 8/1998 |
| JP | 2000-158680 A | 6/2000 |
| WO | WO 9852762 A | 11/1998 |

OTHER PUBLICATIONS

Patent Abstracts of Japan vol. 2000, No. 02, Feb. 29, 2000 & JP 11 320914 A.

* cited by examiner

*Primary Examiner*—Manish S. Shah
*Assistant Examiner*—Lam S. Nguyen
(74) *Attorney, Agent, or Firm*—Sughrue Mion, PLLC

(57) ABSTRACT

The present invention has a recording head of jetting ink drops to record, a carriage adapted to be loaded an ink container storing ink to be fed to the recording head in a removable state, and a communication unit of communicating with a storage element for the ink container installed in the ink container. The communication unit can communicate with the storage element for the ink container when the ink container is not loaded on the carriage. Accordingly, the communication unit can communicate with the storage element for the ink container before mounting the ink container on the carriage.

16 Claims, 5 Drawing Sheets

INK-JET PRINTER

TECHNICAL FIELD

The present invention relates to an ink jet recording apparatus for jetting ink drops and recording data.

BACKGROUND ART

As an example of this kind of ink jet printer, Japanese Patent Laid-Open Publication 279344/1990 discloses a printer which has a storage means installed in an ink jet printing head with an ink chamber. The storage means holds operation conditions of the printing head and ink information. The printer is operated on the basis of information which is read from the storage means in an electrically non-contact state using a read/write head installed in the printer so that the printing head is operated optimally. The printing bead of the printer in this example stores ink in the ink chamber and is mounted in a carriage in a removable state so as to have a so-called ink cartridge function.

In this example, information on the printing head and ink can be transferred to the printer in a non-contact state, so that no electrical contact is required and there is no possibility that ink may be adhered to the exposed contact, causing a defective contact. Further, to maintain the contact between the contacts, there is no need to enhance the accuracy of mechanical positions.

In the conventional printer mentioned above, although information on the printing head and ink can be read and written in a non-contact state, data cannot be read and written into the storage means from the printer when the printing head having the ink chamber is not mounted on the carriage.

Incidentally, when the number of kinds of recording apparatus is increased, it is difficult for the same ink cartridge to cover a plurality of recording apparatus. Accordingly, the kind of ink cartridge becomes different for each recording apparatus and a suitable combination of recording apparatus and ink cartridges becomes complicated. Therefore, a user cannot easily judge the compliance between recording apparatus and ink cartridges, and after all, a problem arises that until the point of time when an ink cartridge is opened and actually mounted on a carriage of a recording apparatus, the user cannot judge whether the ink cartridge is suitable to the recording apparatus or not.

When the ink cartridge is mounted on the carriage, the seal for sealing the ink feed port of the ink cartridge is broken by the ink feed needle installed on the carriage side. Then, regardless of whether the recording apparatus is suitable to the ink cartridge or not, the ink in the ink cartridge is consumed by a predetermined amount, with the result that, when the ink cartridge is not suitable, unnecessary consumption of ink is caused.

The present invention was developed to solve the aforementioned problems and is intended to provide an ink jet recording apparatus which is able to communicate with a storage element installed in an ink container before mounting the ink container on a carriage.

DISCLOSURE OF INVENTION

An ink jet recording apparatus according to the present invention comprises: a recording head of jetting ink drops to record, a carriage adapted to be loaded with an ink container storing ink to be fed to said recording head in a removable state, and a communication unit of communicating with a storage element for said ink container installed in said ink container, said communication unit being able to communicate with said storage element for said ink container when said ink container is not loaded on said carriage.

Preferably, said communication unit can communicate with said storage element for said ink container also when said ink container is loaded on said carriage.

Preferably, said communication unit communicates with said storage element for the ink container in a non-contact state.

Preferably, said communication unit includes an antenna.

Preferably, power is supplied to said storage element for said ink container in a non-contact state.

Preferably, said storage element for said ink container can be rewritten and information stored in said storage element for said ink container via said communication unit is read and rewritten.

Preferably, the ink jet recording apparatus further comprises a storage element for said recording head installed in said recording head for storing information concerning said recording head, wherein said communication unit communicates also with said storage element for said recording head.

Preferably, said communication unit communicates with said storage element for said recording head in a non-contact state.

Preferably, said communication unit communicates also with a storage element for a recording medium installed in a package of storage medium to be recorded by said ink jet recording apparatus.

Preferably, said communication unit communicates with said storage element for said recording medium in a non-contact state.

BEST MODE FOR CARRYING OUT THE INVENTION

A printer as an embodiment of the present invention will be explained hereunder with reference to the accompanying drawings.

Figure 1:
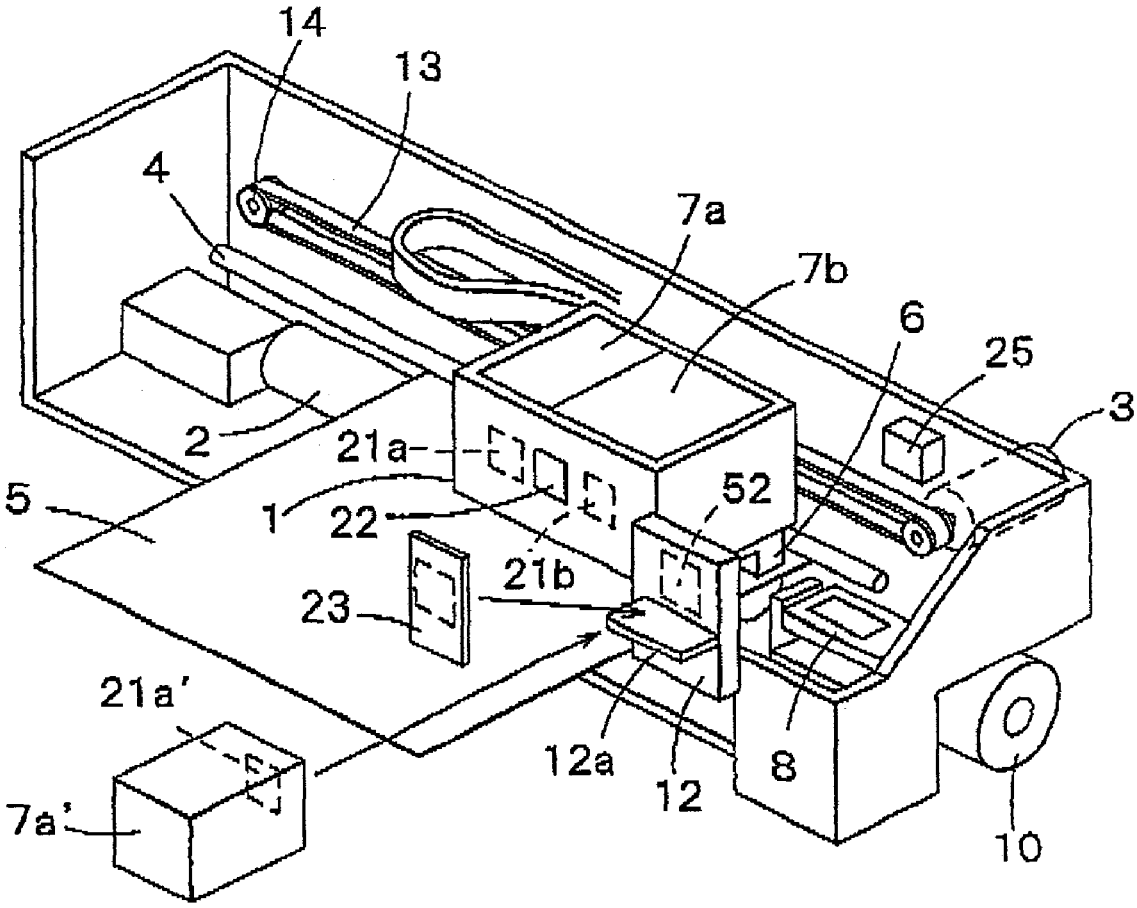
FIG. 1 is a perspective view showing the schematic constitution of the ink jet recording apparatus embodying the present invention.

As shown in FIG. 1, the printer of this embodiment has a carriage 1, a recording head 6 and ink cartridges 7*a* and 7*b* loaded on the carriage 1, a mechanism for driving the carriage 1 along a guide shaft 4 by a carriage motor 3, a mechanism for transferring a recording paper 5 by a paper feed roller 2 driven by a paper feed motor 10, and a head cap 8 for sealing the recording head 6 and sucking ink from the recording head 6.

The mechanism for moving the carriage 1 back and forth in the direction of the shaft of the paper feed roller 2 is composed of the guide shaft 4 installed in parallel with the shaft of the paper feed roller 2 for holding the carriage 1 in a slidable state, pulleys 14 connected to the carriage motor 3 via a driving belt 13, and a position sensor 25 for detecting the home position of the carriage 1.

The ink cartridge 7*a* on the carriage 1 contains black ink (K) and the ink cartridge 7*b* contains 5 colors of inks of cyan ink (C), magenta ink (M), yellow ink (Y), light cyan ink (LC), and light magenta ink (LM). Light cyan ink and light magenta ink are inks having a dye content of ¼ to cyan ink and magenta ink respectively and used to form light color dots.

Tags 21*a* and 21*b* having built-in storage elements capable of being rewritten in an electrically non-contact state are put on the respective sides of the ink cartridges 7*a* and 7*b*.

Further, a tag 22 having a built-in storage element capable of being read in an electrically non-contact state is put on the side of the carriage 1.

The printer has an outer casing 12 only a part of which is shown in FIG. 1 and a transmitting-receiving antenna 52 is arrange on the inner surface of the outer casing 12. The transmitting-receiving antenna 52 can receive both a signal generated from inside the outer casing 12 and a signal generated from outside the outer casing 12. On the outer surface of the outer casing 12, a projection 12*a* for loading a commercial tag 23 having a built-in storage element which is attached to the recording paper package is provided in the position opposite to the transmitting-receiving antenna 52.

Further, when the surface of another ink cartridge 7*a*' to which a tag 21*a*' is stuck is brought close to the transmitting-receiving antenna 52 opposite to it from outside the outer casing 12, the communication unit can also communicate with the tag 21*a*' of the ink cartridge 7*a*' not mounted on the carriage 1.

Figure 2A:
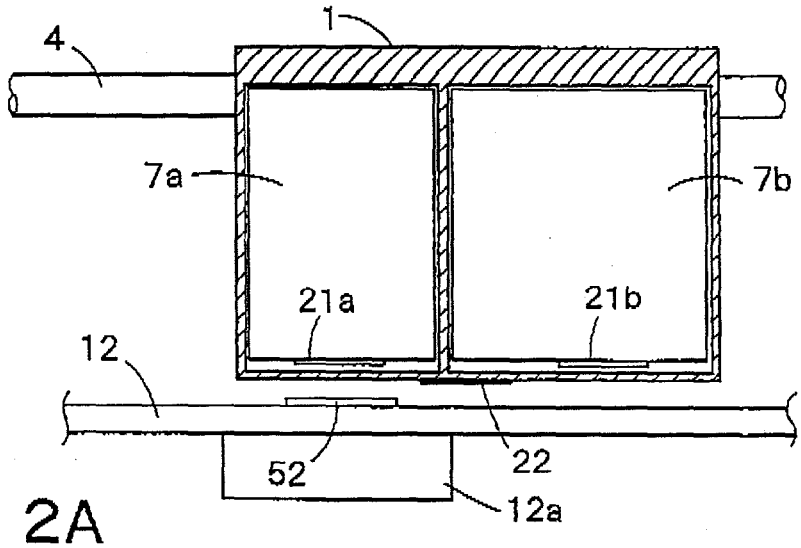
FIGS. 2A, 2B, and 2C show plan views showing the schematic constitution of a carriage of the ink jet recording apparatus embodying the present invention and the periphery thereof.
Figure 2B:
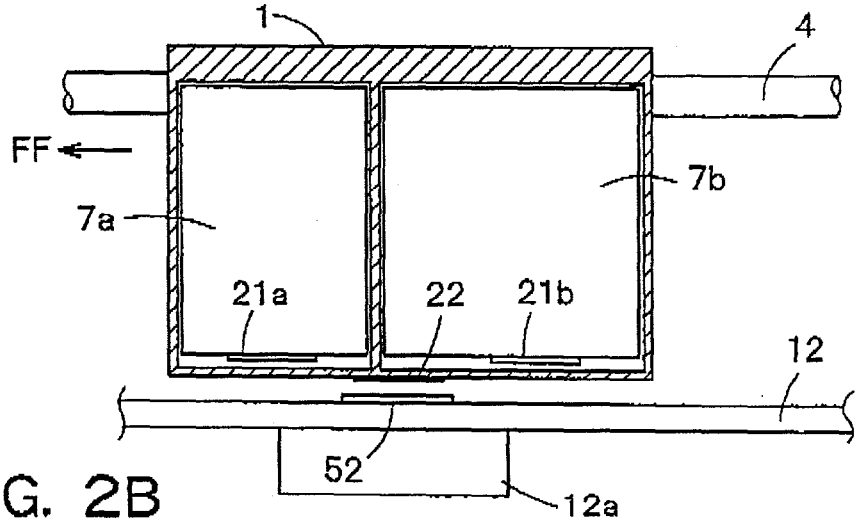
Figure 2C:
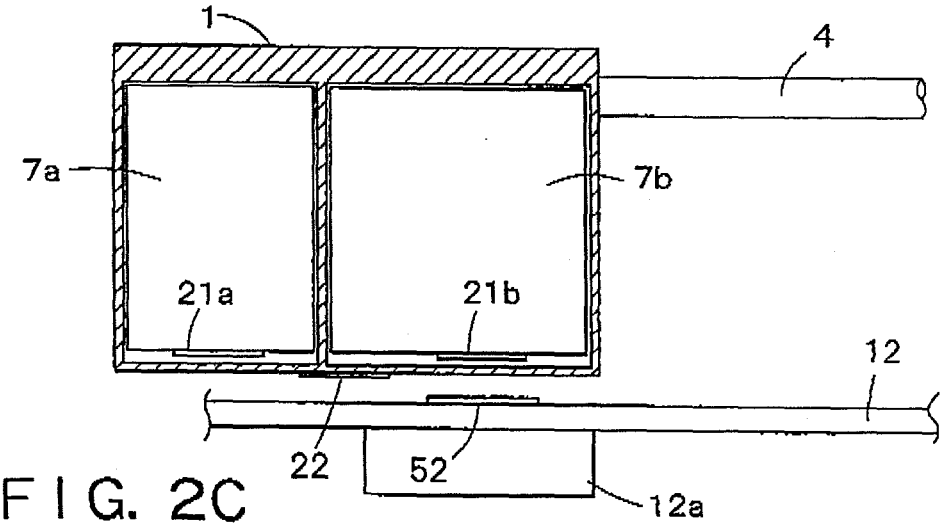

FIGS. 2A, 2B, and 2C are drawings of the carriage 1 and the periphery thereof viewed from above and among them, FIG. 2A shows the carriage 1 in the standby position. In this case, the transmitting-receiving antenna 52 is opposite to the tag 21*a* stuck to the ink cartridge 7*a* and can communicate with a storage element 53*a* (shown in FIG. 3). By doing this, ink information of the ink cartridge 7*a* can be obtained and information on the consumption of ink can be written.

Next, FIG. 2B shows the condition that the carriage 1 moves in the direction of the arrow FF and the tag 22 of the recording head 6 is opposite to the antenna 52. In this case, the antenna 52 can communicate with a storage element 55 (shown in FIG. 3) where information of the recording head 6 is written and can obtain the information of the recording head 6.

Next, FIG. 2C shows the condition that the carriage 1 further moves in the direction of the arrow FF and the tag 21*b* on the ink cartridge 7*b* is opposite to the antenna 52. In this case, the antenna 52 can communicate with a storage element 53*b* (shown in FIG. 3) where information of the ink cartridge 7*b* is written, obtain the information of the ink cartridge 7*b*, and write information of the consumption of ink.

Further, when the tag 23 stuck to the package of the recording paper 5 is put on the projection 12*a* of the outer casing 12 shown in FIG. 1, the antenna 52 is opposite to the tag 23 and can obtain information on the recording paper 5.

Furthermore, when the surface of the ink cartridge 7*a*' to which the tag 21*a*' is stuck is brought close to the projection 12*a* of the outer casing 12, the tag 21*a*' is opposite to the antenna 52. By doing this, the antenna 52 can communicate with a storage element 53*a*' (shown in FIG. 3) of the tag 21*a*' and can obtain the information of the ink cartridge 7*a*' before loading the ink cartridge 7*a*' on the carriage 1. In the ink cartridge 7*a*' in this case, the non-contact electromagnetic coupling is not disturbed even when the ink cartridge 7*a*' is sealed by a resin film, so that the communication by the transmitting-receiving antenna 52 is made possible.

Figure 3:
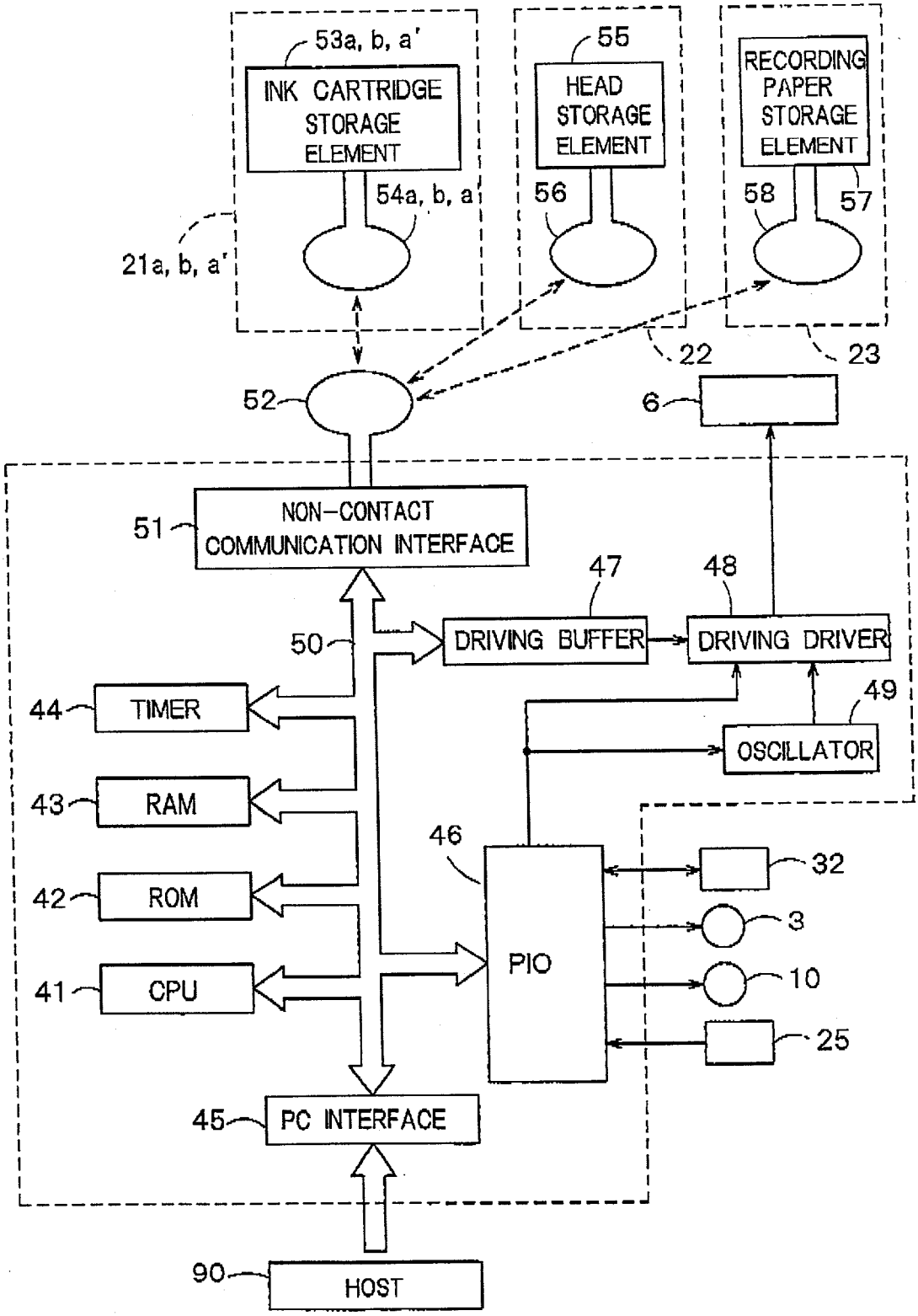
FIG. 3 is an illustration showing the inter constitution of a control circuit of the ink jet recording apparatus embodying the present invention.

As shown in FIG. 3, in the control circuit of the printer, a CPU 41, a PROM 42, and a RAM 43 connected by a path 50, a PC interface 45 for transmitting and receiving data with a host 90, a paper feed motor 10, a peripheral I/0 unit (PIO) 46 for transmitting and receiving signals with the carriage motor 3 and an operation panel 32, and a timer 44 for timing are installed. In the control circuit, a driving buffer 47 for outputting ink-dot ON and OFF signals to the recording head 6, an oscillator 49 for outputting a timing signal of driving waveform as a voltage signal for driving a piezo-electric element at a predetermined frequency, and a driving circuit 48 for outputting a driving waveform to the recording head 6 by the timing signal of the oscillator 49 are installed additionally.

The control circuit receives dot data processed by the host 90, stores it in the RAM 43 temporarily, and outputs it to the driving buffer 47 at predetermined timing. Further, a non-contact communication interface 51 for communicating with the tags 21*a*, 21*b*, 21*a* ', 22, and 23 respectively attached to the ink cartridges 7*a*, 7*b*, and 7*a*', the recording head 6, and the recording paper 5 is installed. To the non-contact communication interface 51, the transmitting-receiving antenna 52 is connected and the interface 51 communicates with the tags 21*a*, 21*b*, 21*a*', 22, and 23 via the antenna 52.

The tags 21*a*, 21*b*, 21*a*', 22, and 23 are respectively composed of the storage elements 53*a*, 53*b*, 53*a*', 55, and 57 and antennas 54*a*, 54*b*, 54*a*', 56, and 58 and by the electromagnetic coupling when the antennas 54*a*, 54*b*, 54*a*', 56, and 58 respectively become opposite to the antenna 52 on the recording apparatus side, the interface 51 communicates with them.

In the storage elements 53*a*, 53*b*, and 53*a*' of the tags 21*a*, 21*b*, and 21*a*' attached to the ink cartridges 7*a*, 7*b*, and 7*a*', information such as the residual amount of ink of each color, ink kind, manufacturing date, and serial number is stored beforehand and the information is read by the control circuit of the printer and used for record control and maintenance control.

For example, with respect to the information of residual amount of ink, the ink dot amount used for recording, the ink consumption during head cleaning, and the nozzle flashing amount are calculated by the control circuit of the printer, and the calculated values are subtracted from the residual amounts of ink stored in the storage elements 53*a*, 53*b*, and 53*a*', and the results are written into the storage elements 53*a*, 53*b*, and 53*a* ' again. By doing this, the residual amounts of ink in the ink cartridges 7*a*, 7*b*, and 7*a*' can be confirmed accurately and at the point of time when the residual amount of ink of any ink cartridge becomes 0, exchange of the ink cartridge can be notified to a user.

Further, the information of ink kind may be used to judge whether the ink stored in the ink cartridges 7*a*, 7*b*, and 7*a*' is suitable to the concerned printer. When the ink is not suitable to the printer, a warning may be given to the user. Further, the information of ink kind may be used to perform a most suitable color correction process for the ink kind.

Furthermore, the cumulative times from the time of mounting of the cartridges 7*a*, 7*b*, and 7*a*' on the carriage 1 are written in the storage elements 53*a*, 53*b*, and 53*a*' and at the time of head maintenance, the head maintenance according to the change of ink with time can be executed on the basis of the cumulative times stored in the storage elements 53*a*, 53*b*, and 53*a'*.

In the recording element 55 on the tag 22 attached to the recording head 6, driving conditions for keeping the weight and speed of ink drops to be jetted from the recording head 6 constant, for example, the driving voltage which is a parameter of driving waveform, the driving time, and the factor according to temperature change are stored and the printer control circuit reads each condition from the storage element 55 via the transmitting-receiving antenna 52 and drives the recording head 6 optimally.

In the recording element 57 on the tag 23 attached to the recording paper 5, information such as the weight of ink drops most suitable for the recording paper 5, color correction parameter, and recording method is written and when the tag 23 is put on the projection 12*a* of the outer casing 12, the printer control circuit reads the information in the storage element 57 via the transmitting-receiving antenna 52 and automatically sets most suitable recording conditions on the recording paper 5.

Figure 4:
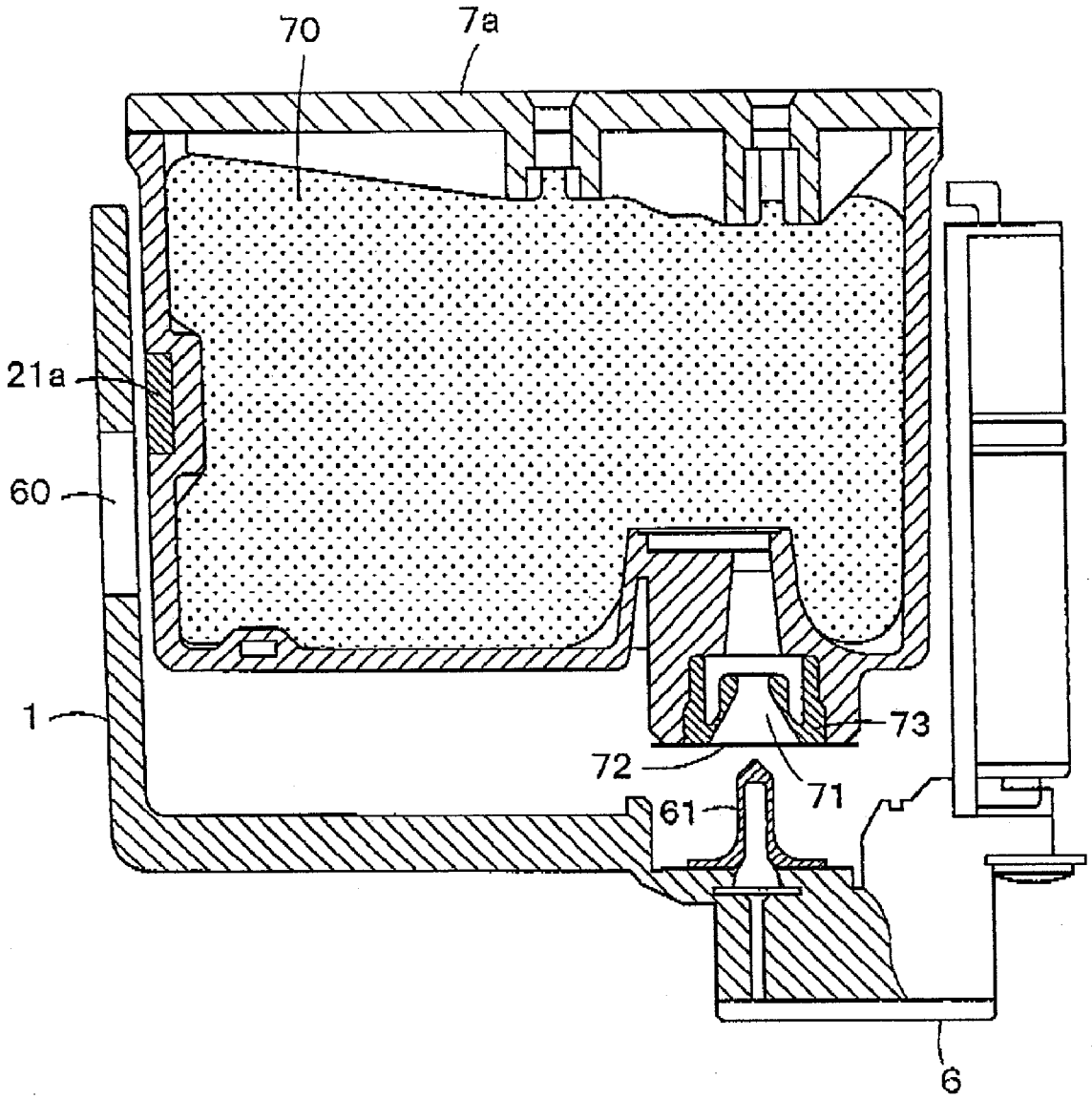
FIG. 4 is a sectional view showing the intervening condition of the operation of mounting an ink cartridge on a carriage in the ink jet recording apparatus embodying the present invention.
Figure 5:
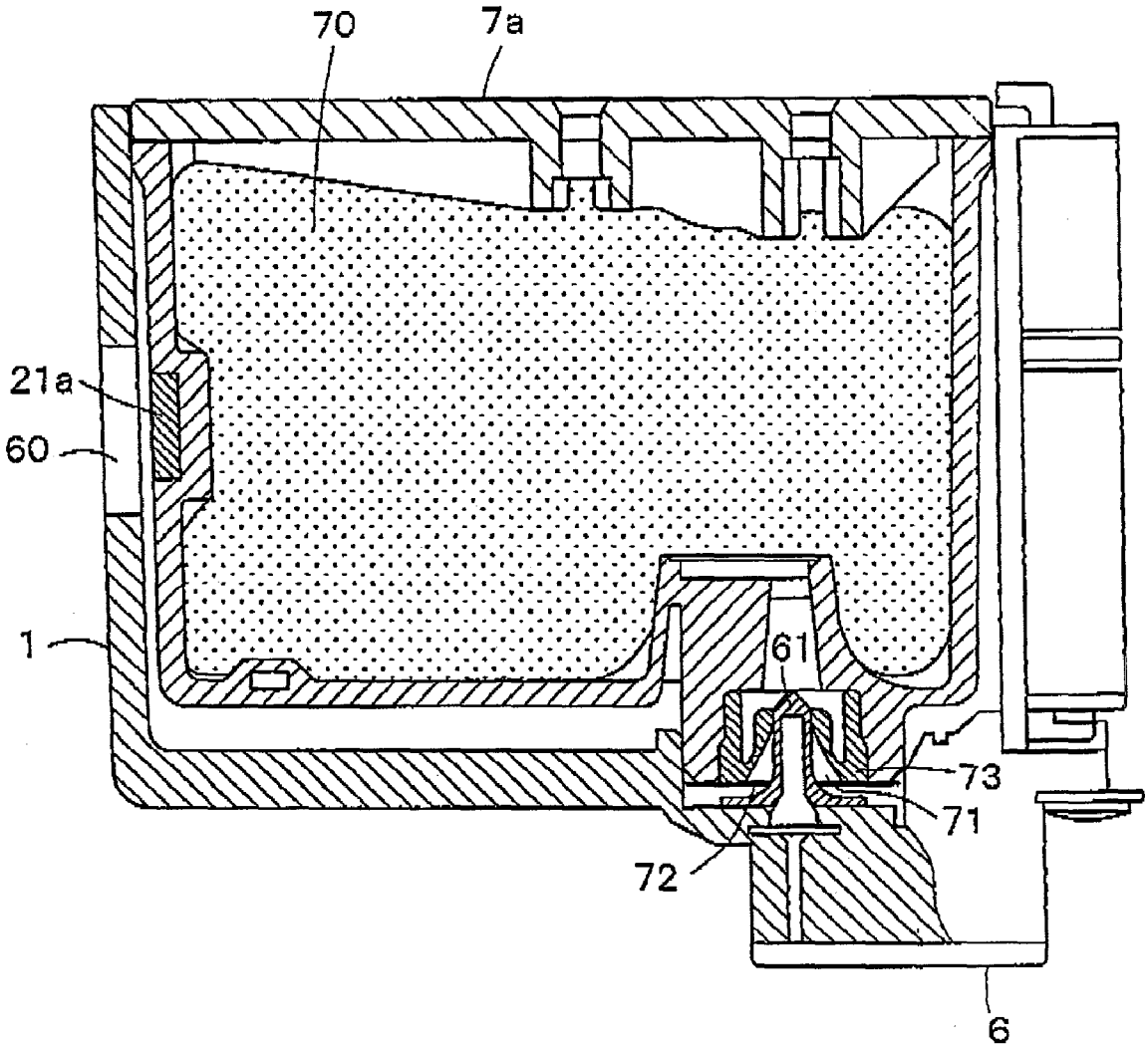
FIG. 5 is a sectional view showing the condition that an ink cartridge is perfectly mounted on a carriage in the ink jet recording apparatus embodying the present invention.

FIG. 4 shows the intervening condition of the operation of mounting the ink cartridge 7*a* on the carriage 1 of the printer of this embodiment and FIG. 5 shows the condition that the ink cartridge 7*a* is perfectly mounted on the carriage 1. On the side of the carriage 1, a window 6 is formed and in a state that the ink cartridge 7*a* is perfectly mounted on the carriage 1, the tag 21*a* composed of an IC attached to the side of the ink cartridge 1 is opposite to the window 60.

In the ink cartridge 7*a*, a porous member 70 for holding ink is filled. As shown in FIG. 4, in the ink cartridge 7*a* not in use, an ink feed port 71 is sealed by a sealing film 72. When the ink cartridge 7*a* is mounted on the carriage 1, as shown in FIG. 5, the sealing film 72 is broken by an ink feed needle 61 installed on the carriage 1. The ink feed needle 61 passing through the sealing film 72 is inserted into a sealing rubber member 73 installed at the ink feed port 71 and ink in the ink cartridge 7*a* flows on the side of the recording head 6 via the ink feed needle 61.

As mentioned above, when the ink cartridge 7*a* is mounted on the carriage, the sealing film 72 of the ink cartridge 7*a* is broken and ink in the ink cartridge 7*a* flows on the side of the recording head 6. Therefore, it is desirable to prevent an unsuitable ink cartridge from mounting on the carriage 1 and prevent unnecessary consumption of ink.

Accordingly, when the ink cartridge 7*a* is to be mounted on the carriage 1 of the printer of this embodiment, the information in the tag 21*a* of the ink cartridge 7*a* is read via the transmitting-receiving antenna 52, and it is ascertained that the ink cartridge 7*a* is suitable, and then the ink cartridge 7*a* is mounted on the carriage 1. By doing this, unnecessary ink consumption due to mounting of an unsuitable ink cartridge can be prevented.

Although the embodiment of the present invention is explained above, the technical scope of the present invention is not limited to the scope described in the embodiment. To the aforementioned embodiment, various changes and improvements can be added. As shown by the description in the claims of the patent, an embodiment with such changes and improvements added can be included in the technical scope of the present invention.

As shown by the above explanation, according to the present invention, when the ink container is brought close to the communication unit of the ink jet recording apparatus, the communication unit can communicate with the storage element for the ink container installed in the ink container, so that before mounting the ink container on the carriage of the ink jet recording apparatus, it is possible to ascertain the ink kind in the ink container and ascertain the suitability of the ink container with the ink jet recording apparatus. Therefore, the suitability of the ink container can be ascertained easily and quickly and unnecessary ink consumption due to mounting of an unsuitable ink container on the carriage can be prevented.

Further, according to the present invention, even after the ink container is mounted on the carriage, a same communication unit as that used before mounting can communicate with the storage element for the ink container. Since the common use of the communication unit can be realized like this, structural simplification and cost reduction of the ink jet recording apparatus can be realized.

Furthermore, according to the present invention, the communication unit can communicate with not only the storage element for the ink container but also the storage element for the recording head installed on the recording head or the storage element for the recording medium installed on the package of recording medium, so that a most suitable recording process can be performed.

The invention claimed is:

1. An ink jet recording apparatus comprising:

a recording head that jets ink drops to record, a carriage adapted to be loaded with a plurality of detachable ink containers each of which stores ink to be fed to said recording head, wherein said carriage reciprocally moves with said recording head, and a communication unit including a single antenna for communicating with storage elements which are provided with said ink containers, respectively, said communication unit being able to communicate with said storage elements provided with said ink containers not only when said ink containers are loaded on said carriage, but also when said ink containers are not loaded on said carriage, wherein in a state that one ink container of said ink containers is loaded on said carriage, said communication unit is able to communicate with one storage element of said storage elements for said one ink container only when said one storage element is brought close to said communication unit, said communication between said communication unit and said one storage element ink being enabled at least during a portion of said reciprocal movement and, wherein in a state that said one ink container is not loaded on said carriage, said communication unit is able to communicate with said one storage element only when said one storage element is brought close to said communication unit to such a distance that said one storage element is able to communicate with said communication unit in the state that said one ink container is loaded on said carriage.

2. An ink jet recording apparatus according to claim 1, wherein said communication unit communicates with said one storage element for the one ink container in a non-contact state.

3. An ink jet recording apparatus according to claim 2, wherein power is supplied to said one storage element for said one ink container in a non-contact state.

4. An ink jet recording apparatus according to claim 1, wherein information within said one storage element for said one ink container can be rewritten and stored in said one storage element at least via said communication unit reading and writing.

5. An ink jet recording apparatus according to claim 1, further comprising a storage element for said recording head installed in said recording head for storing information concerning said recording head, wherein said communication unit communicates also with said storage element for said recording head.

6. An ink jet recording apparatus according to claim 5, wherein said communication unit communicates with said storage element for said recording head in a non-contact state.

7. An ink jet recording apparatus according to claim 1, wherein said communication unit communicates also with a storage element for a recording medium installed in a package of storage medium to be recorded by said ink jet recording apparatus.

8. An ink jet recording apparatus according to claim 7, wherein said communication unit communicates with said storage element for said recording medium in a non-contact state.

9. An ink jet recording apparatus comprising:

a recording head;

a carriage, which reciprocally moves with the recording head and on which a plurality of ink containers are detachably mounted, wherein the ink containers comprise memories, respectively; and a communication circuit including a single antenna that communicates with the memories provided when the ink containers are mounted on the carriage and when said ink containers are not mounted on the carriage, wherein, when one ink container of the ink containers is mounted on the carriage, the communication circuit communicates with one memory of memories when the carriage moves the one memory close to the communication circuit.

10. An ink jet recording apparatus according to claim 9, wherein said communication circuit communicates with the one memory in a non-contact state.

11. An ink jet recording apparatus according to claim 10, wherein power is supplied to the one memory in the non-contact state.

12. An ink jet recording apparatus according to claim 9, wherein the communication circuit can read information from and write information to the one memory.

13. An ink jet recording apparatus according to claim 9, wherein the recording head comprises a head memory that stores information concerning the recording head, wherein said communication circuit communicates with the head memory.

14. An ink jet recording apparatus according to claim 13, wherein the communication circuit communicates with the head memory in a non-contact state.

15. An ink jet recording apparatus according to claim 9, wherein a recording medium that receives information recorded via the recording head is stored in a package, wherein the package comprises a recording medium memory, and wherein the communication circuit communicates with the recording medium memory.

16. An ink jet recording apparatus according to claim 15, wherein the communication circuit communicates with the recording medium memory in a non-contact state.

* * * * *